US010640282B2

(12) United States Patent
Ehrensperger et al.

(10) Patent No.: US 10,640,282 B2
(45) Date of Patent: May 5, 2020

(54) ADAPTER FOR PRODUCT DISPENSER AND PRODUCT DISPENSER

(71) Applicant: C. Ehrensperger AG, Stäfa (CH)

(72) Inventors: Christian Ehrensperger, Rüschlikon (CH); Marco Sigg, Zürich (CH)

(73) Assignee: C. Ehrensperger AG, Stäfa (CH)

( * ) Notice: Subject to any disclaimer, the term of this patent is extended or adjusted under 35 U.S.C. 154(b) by 0 days.

(21) Appl. No.: 16/377,287

(22) Filed: Apr. 8, 2019

(65) Prior Publication Data

US 2019/0315558 A1 Oct. 17, 2019

(30) Foreign Application Priority Data

Apr. 13, 2018 (DE) ..... 10 2018 108 846

(51) Int. Cl.
*B65D 83/20* (2006.01)
*B65D 83/22* (2006.01)

(52) U.S. Cl.
CPC ..... *B65D 83/206* (2013.01); *B65D 83/22* (2013.01); *B65D 2101/0023* (2013.01)

(58) Field of Classification Search
CPC ..... B65D 83/206; B65D 2101/0023; B65D 83/22
USPC ..... 222/402.11, 487, 402.13
See application file for complete search history.

(56) References Cited

U.S. PATENT DOCUMENTS 2,169,779 A * 8/1939 Loewe ..... A47G 19/12 222/487
3,180,532 A * 4/1965 Michel ..... B65D 83/40 222/182
4,826,054 A * 5/1989 Frutin ..... B65D 83/201 222/402.11
5,027,986 A * 7/1991 Heinzel ..... B65D 83/205 222/402.1
5,785,301 A * 7/1998 Scheindel ..... B65D 83/46 222/402.22
5,971,230 A * 10/1999 Tanaka ..... B65D 83/205 222/402.1
6,340,103 B1 * 1/2002 Scheindel ..... B65D 83/201 222/402.15
6,474,510 B2 * 11/2002 Frutin ..... B65D 83/201 222/153.11

(Continued)

FOREIGN PATENT DOCUMENTS

DE 10 2007 041 985 A1 3/2009
DE 10 2008 051 888 A1 4/2010

(Continued)

*Primary Examiner* — Patrick M. Buechner
*Assistant Examiner* — Michael J. Melaragno
(74) *Attorney, Agent, or Firm* — Renner, Otto, Boisselle & Sklar, LLP

(57) ABSTRACT

The invention relates to an adapter for a product dispenser (11) with an adapter base body (19) for positioning the adapter (18) on a container opening (14) of a pressure container (12), with a swivel arrangement (23), which adjusts an actuating lever (21) with a handle (22) swivellably to the adapter base body (19), wherein the actuating lever (21) is transferable from an unlocked position (67), in which the handle (22) can be operated from a starting position (68) into an active position (69) for opening a valve (16) of the container (12), to a locked position (66), in which operation of the handle (22) is blocked.

16 Claims, 12 Drawing Sheets

(56) References Cited

U.S. PATENT DOCUMENTS

Figure 1:
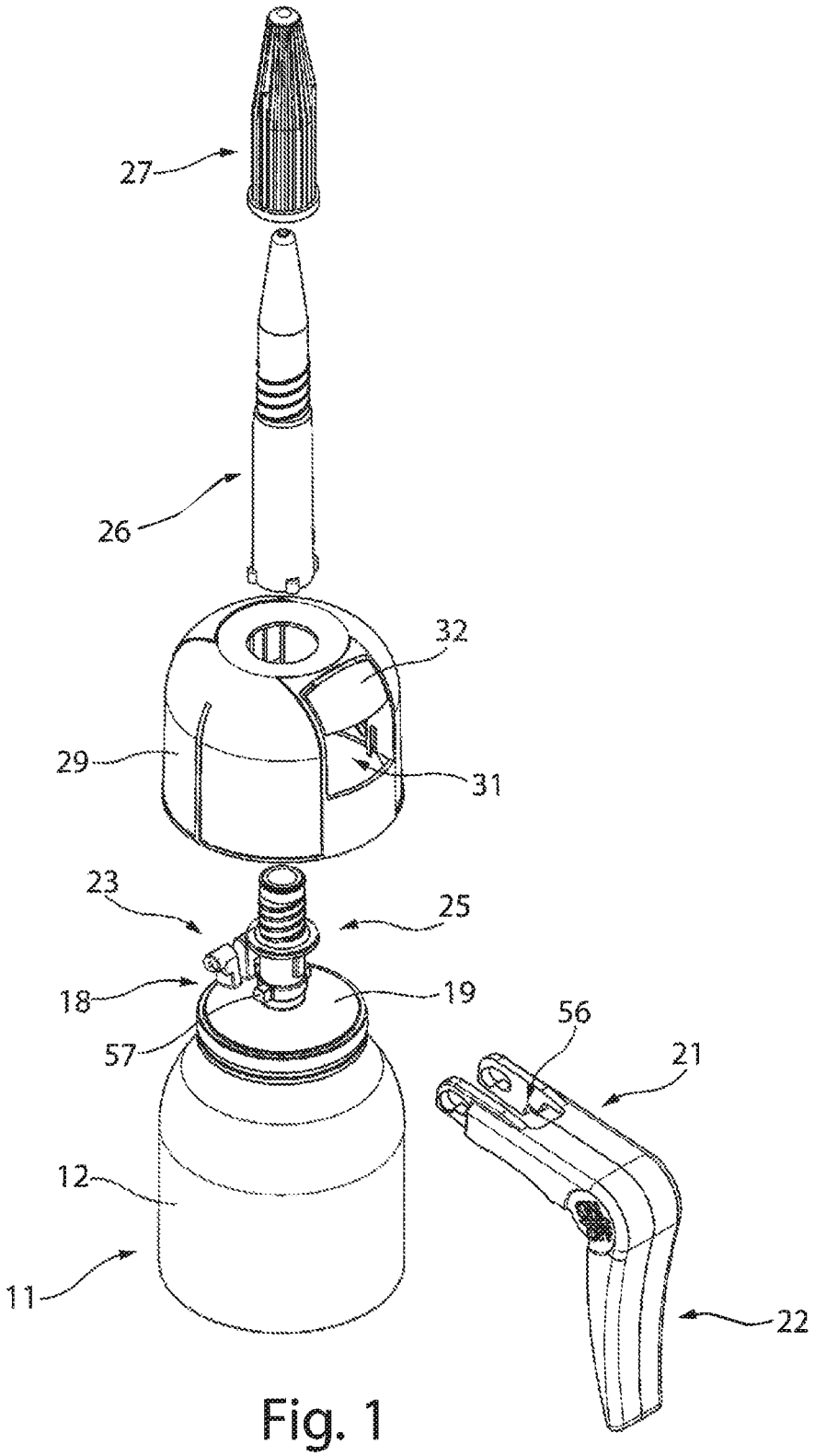

| | | | | |
|---|---|---|---|---|
| 6,685,064 | B2 * | 2/2004 | Frutin | B65D 83/201 222/153.12 |
| 6,820,777 | B2 * | 11/2004 | Frutin | B65D 83/201 222/153.12 |
| 7,249,692 | B2 * | 7/2007 | Walters | B05B 11/3014 222/153.11 |
| 7,641,079 | B2 * | 1/2010 | Lott | B65D 83/201 222/153.07 |
| 8,235,253 | B2 * | 8/2012 | Shew | F16N 3/12 222/256 |
| 8,528,794 | B2 * | 9/2013 | Wolf | B05B 1/30 222/402.15 |
| 2009/0145928 | A1 * | 6/2009 | De LaForcade | B65D 83/201 222/153.11 |
| 2010/0147893 | A1 * | 6/2010 | Shew | F16N 3/12 222/256 |
| 2013/0277397 | A1 * | 10/2013 | Erickson | B65D 83/22 222/153.11 |
| 2016/0194140 | A1 * | 7/2016 | Sell | B65D 83/22 222/153.11 |

FOREIGN PATENT DOCUMENTS

| | | |
|---|---|---|
| DE | 10 2009 018 528 A1 | 11/2010 |
| DE | 20 2009 018 628 U1 | 6/2012 |
| DE | 10 2013 203 834 A1 | 9/2014 |
| EP | 1 242 295 B3 | 12/2008 |

* cited by examiner

ADAPTER FOR PRODUCT DISPENSER AND PRODUCT DISPENSER

This application claims priority to German Patent Application No. 10 2018 108 846.9 filed on Apr. 13, 2018, which is hereby incorporated herein by reference.

The invention relates to an adapter for a product dispenser and a product dispenser for outputting a medium.

A dispenser for outputting an adhesive or sealant from a pressure container via a valve is known from DE 10 2007 041 985 A1. The dispenser has a lever for actuating the valve. The lever is swivellable here about a horizontal axis perpendicular to the longitudinal axis of an output sleeve. Furthermore, the actuating lever can be swiveled radially about a longitudinal axis of the output sleeve for dosing of the medium.

Another dispenser for outputting a medium from a pressure container is known from DE 10 2013 203 834 A1. On this container an output valve is provided, which is surrounded by a cap.

This cap engages on the pressure container. An actuating lever is provided on the cap. This actuating lever is provided movably horizontally from a packaging position through a guide groove relative to the longitudinal axis of the valve on the pressure container. Following withdrawal via a sliding guide, the actuating lever can be swiveled about a film hinge on the cap and the output sleeve can be actuated.

Another dispenser for outputting a medium from a pressure container via an output valve with a lever is known from DE 10 2009 018 528 A1. The lever is provided on an adapter attachment for positioning on the container. The lever can be transferred here along a displacement path, which is inclined at an angle of 45° to the longitudinal axis of the adapter attachment, to an actuating position, in order subsequently to control a swivel movement for outputting the medium via the output valve.

A product dispenser for outputting a medium is known from EP 1 242 295 B3. This product dispenser comprises a valve, which closes a container opening of a pressure container for receiving a medium to be output. Associated with the container opening an adapter is provided, which has an actuating lever for controlling the valve. The actuating lever is attached by way of a swivel arrangement on the adapter, wherein the actuating lever is transferable from a starting position, in which the valve is closed, by a swivel movement into an active position, in which the valve is operated to output the medium.

Another product dispenser for outputting a medium from a pressure container is known from DE 20 2009 018 628 U1. This product dispenser comprises an actuating lever with a handle arranged thereon, which is positioned rotating about a longitudinal axis of the valve output opening. Due to the rotating arrangement of the swivel lever about the longitudinal axis of the valve output opening, a product discharge rate can be adjusted continuously between a maximum rate and a minimum rate. To output the product, the actuating lever can be swiveled in the direction of the pressure container in order to release the valve into an active position for outputting the medium as a function of the set discharge rate.

The object of the invention is to propose an adapter for a product dispenser as well as a product dispenser, in which unintentional output of the medium is prevented during transportation.

This object is achieved by an adapter for a product dispenser that can be attached on both sides to a container opening of a pressure container. The adapter has a swivel arrangement, which supports the actuating lever with the handle arranged thereon swivellably relative to the adapter base body, wherein the actuating lever is transferable from an unlocked position, in which the actuating lever is swivellable between the starting position, in which the valve is closed, and an active position, in which the valve is open, to a locked position. The swivel arrangement of the adapter is formed by a swivel axis and at least one slot and the swivel axis can be arranged in a first and in a second end position inside the slot. The actuating lever can be arranged thereby in two positions, namely a first end position, which preferably corresponds to the locked position, and in a second end position, which corresponds to the unlocked position, for example, by a displacement movement. In the locked position the actuating lever is secured and cannot be operated. An output of the medium is blocked. A transport safeguard is enabled thereby. Due to the arrangement of the actuating lever in the locked position, the output of the pressure medium can be prevented in the case of a pressure acting on the handle, for example due to an adjacent product dispenser, in a packaging unit or in the event of the pressure container falling over.

The displacement movement of the actuating lever is preferably guided by the swivel arrangement and the actuating lever is displaceable relative to an output sleeve on the adapter base body. A simple and compact arrangement can be created thereby.

The actuating lever can preferably be arranged in the locked position and in the unlocked position by a displacement movement. The actuating lever with the handle arranged thereon can thus be transferred in a simple manner from a secured position to an unlocked position, in order subsequently to output the medium in a controlled manner by the user.

The slot of the swivel arrangement preferably has an angled progression, due to which the handle can be adjusted from the locked position to the unlocked position. This angled progression of the slot has the advantage that the swivel axis does not shift on withdrawal/swiveling of the actuating lever. This swivel axis is drawn downwards relative to the handle, and the handle cannot inadvertently slip forwards or backwards. In addition, a greater distance can be created to the adapter base body and the outer wall of the pressure container. This permits additional free space for the operation of the handle, in order to transfer the valve from a starting position, in which the valve is closed, to an active position for outputting the medium.

The displacement movement of the actuating lever between the first and second end position preferably has a first displacement path, which is provided transverse respectively radial to the longitudinal axis of the valve opening of the pressure container and of the adapter base body, and a second displacement path attached thereto, which is inclined with respect to the first displacement path. This has the advantage that in a locked position the handle can be positioned close to an outer wall of the pressure container or resting on it. In the unlocked position, the handle is spaced by a distance from the outer wall of the pressure container and permits a swivel movement to operate the valve and output the medium.

The actuating lever preferably has a stop, which is provided pointing towards an adapter base body, which can be positioned on the container opening. A projection arranged on the output sleeve, which projection points towards the actuating lever, is preferably provided lying opposite the stop. The actuating lever can thereby be arranged in a first end position of the swivel arrangement, and a swivel movement of the actuating lever is blocked. The actuating lever is blocked with regard to a swivel movement away from the adapter base body by the projection, which rests on the actuating element. A swivel movement of the actuating lever in the opposite direction towards the adapter base body is blocked by the stop on the actuating lever, which stop rests on the adapter base body. Into and counter to the displacement direction substantially at right angles or transverse to the longitudinal axis of the container opening, on the other hand, a simple release of the actuating lever from this locked position can take place.

The actuating lever is preferably held clamped in the locked position between the projection on the output sleeve and the adapter base body. The locked position can be additionally secured thereby.

Alternatively, on transfer of the swivel arrangement to a first end position, the swivel axis can be led through a constriction in the at least one slot, so that the swivel axis is positioned in a latching manner in the first end position.

According to a first embodiment of the swivel arrangement, the at least one slot, which is connected to a swivel axis arranged fixedly on the adapter base body, is provided at an end of the actuating lever lying opposite the handle. This represents a structurally simple configuration.

Alternatively the swivel axis can also be provided on the actuating lever and the at least one slot can be formed on the adapter base body.

The adapter preferably comprises the adapter base body with an output sleeve, which is connected via an elastic connection, in particular a membrane or a joint, to the adapter base body. The output sleeve can be moved towards the valve. The adapter base body and the output sleeve as well as an elastic connection arranged in between are preferably formed as an injection-molded part from plastic. The displaceable linkage of the output sleeve on the adapter base body, which is preferably formed annularly, can thereby be formed in a simple manner. Easy handling is also provided due to the preferred one-piece design.

In the unlocked position of the actuating lever, an actuating element arranged on the actuating lever can engage on a cam on the output sleeve. Due to a swivel movement of the handle, an axial displacement movement of the output sleeve can be produced in the direction of the valve, by which the valve is transferable into an active position to output the medium.

Furthermore, the output sleeve has on an interior side, viewed in relation to the elastic connection of the output sleeve to the adapter base body, a connection, which engages on the valve, and lying opposite or on an outer side of the adapter base body has a connecting piece, to which a nozzle can be attached. A flow duct can be formed thereby in the adapter base body, which transfers the medium flowing out of the valve via the output sleeve into the nozzle for outputting at the point of use.

Furthermore, a cap can be placed on the adapter base body, which cap encloses at least the swivel arrangement of the adapter, the container opening and at least partially the actuating lever.

This forms a protection of the swivel arrangement against damage.

Furthermore, the cap has a recess, through which the actuating lever is led out, so that the handle is arranged outside the cap. In the recess a tamper-evident closure is preferably provided. It can thereby be established in a simple manner whether this is an as yet unopened product dispenser.

The tamper-evident closure on the cap is provided by at least one web-shaped linkage in the recess. This web-shaped linkage forms a predetermined breaking point, which can be released in a simple manner.

Following the one-time separation of the web-shaped linkage, the tamper-evident closure can remain loose on the cap or be separated completely from the cap. In both cases the user can recognize that the intact state of the goods no longer exists.

The object forming the basis of the invention is further achieved by a product dispenser, which has an adapter according to one of the embodiments described above.

Figure 2:
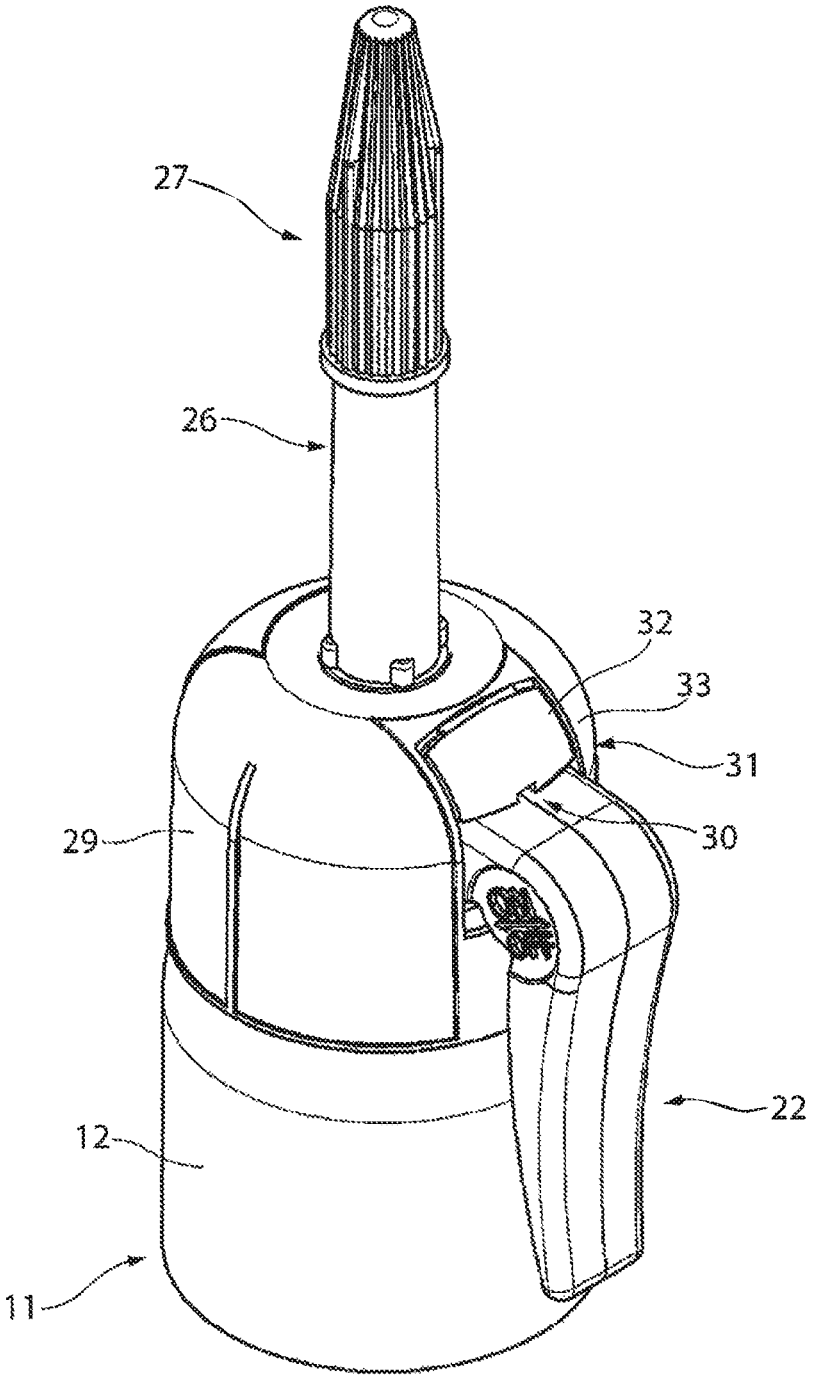
Figure 3:
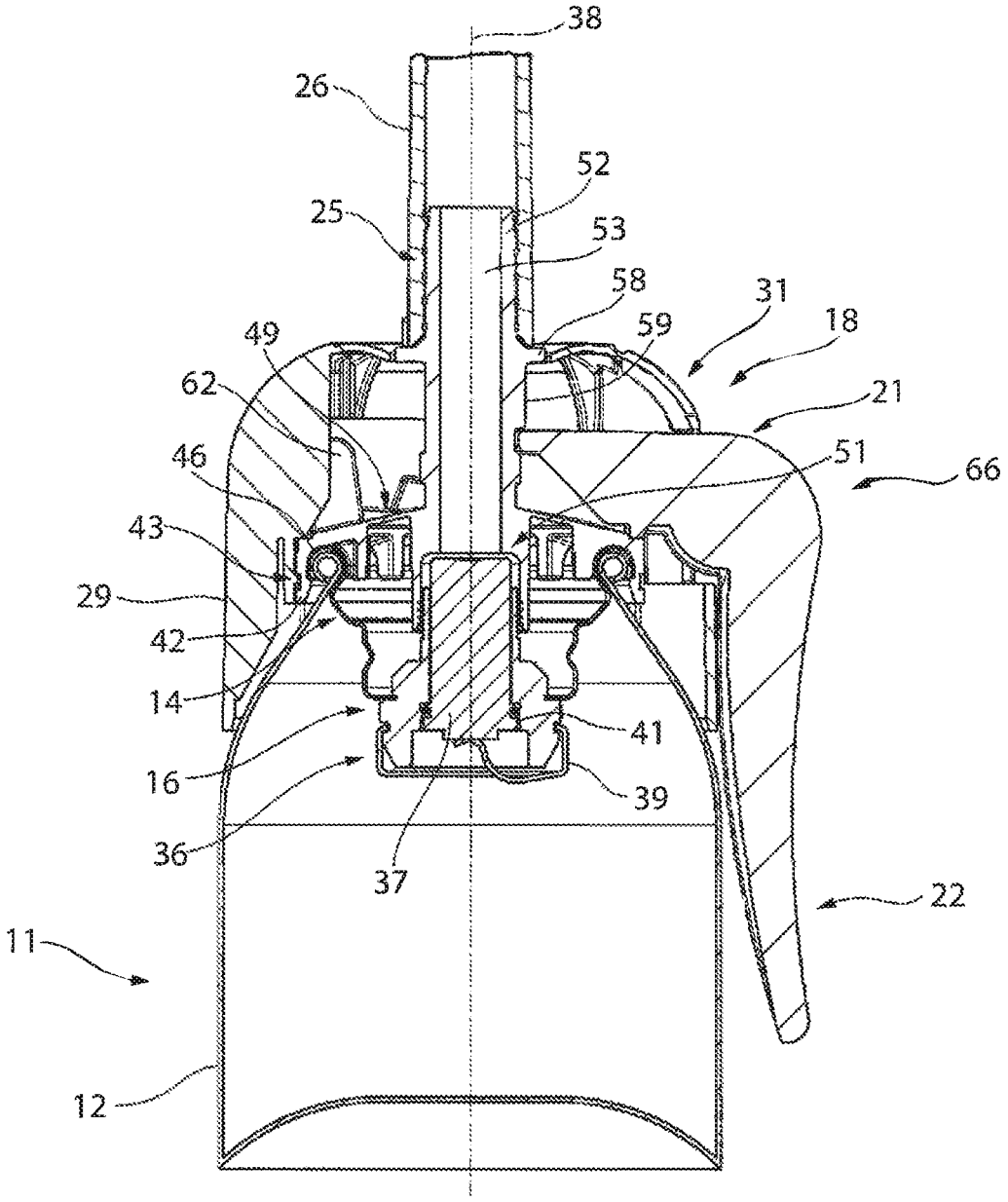
Figure 4:
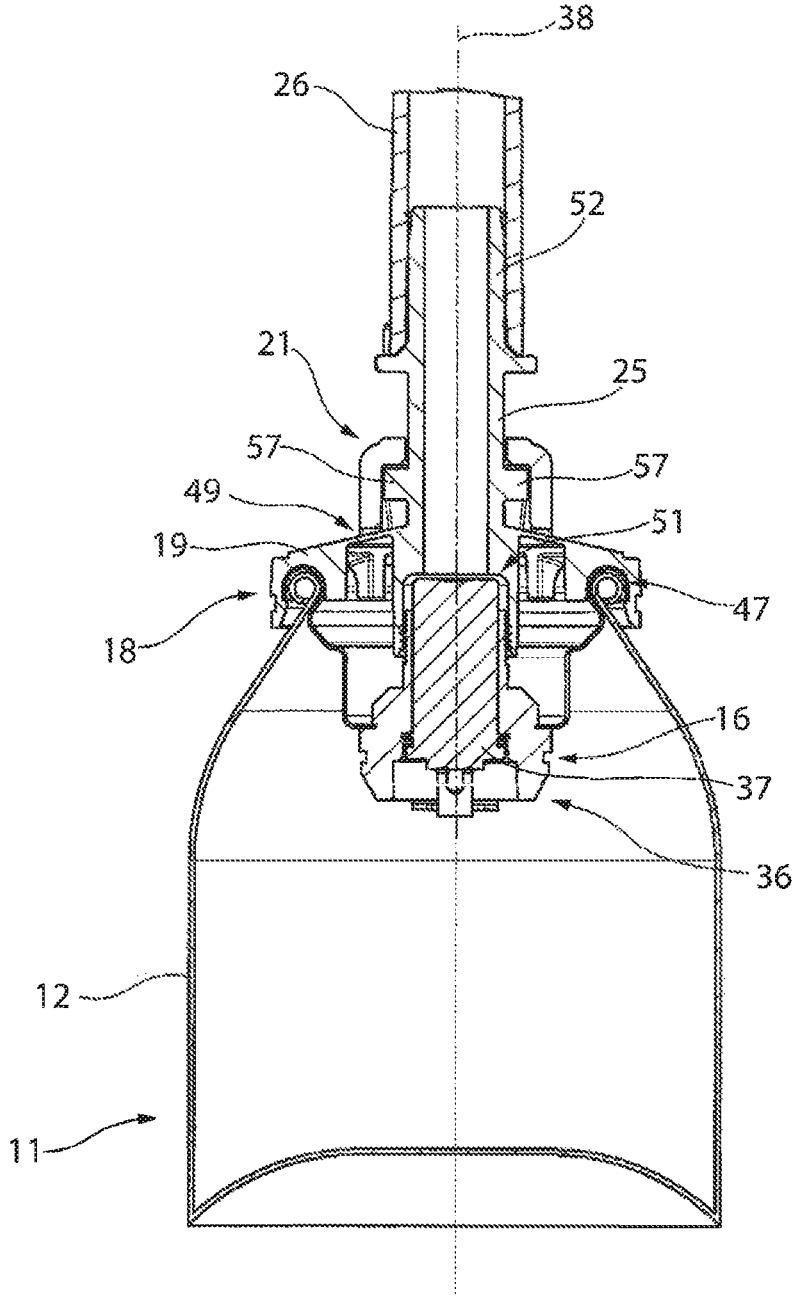
Figure 5:
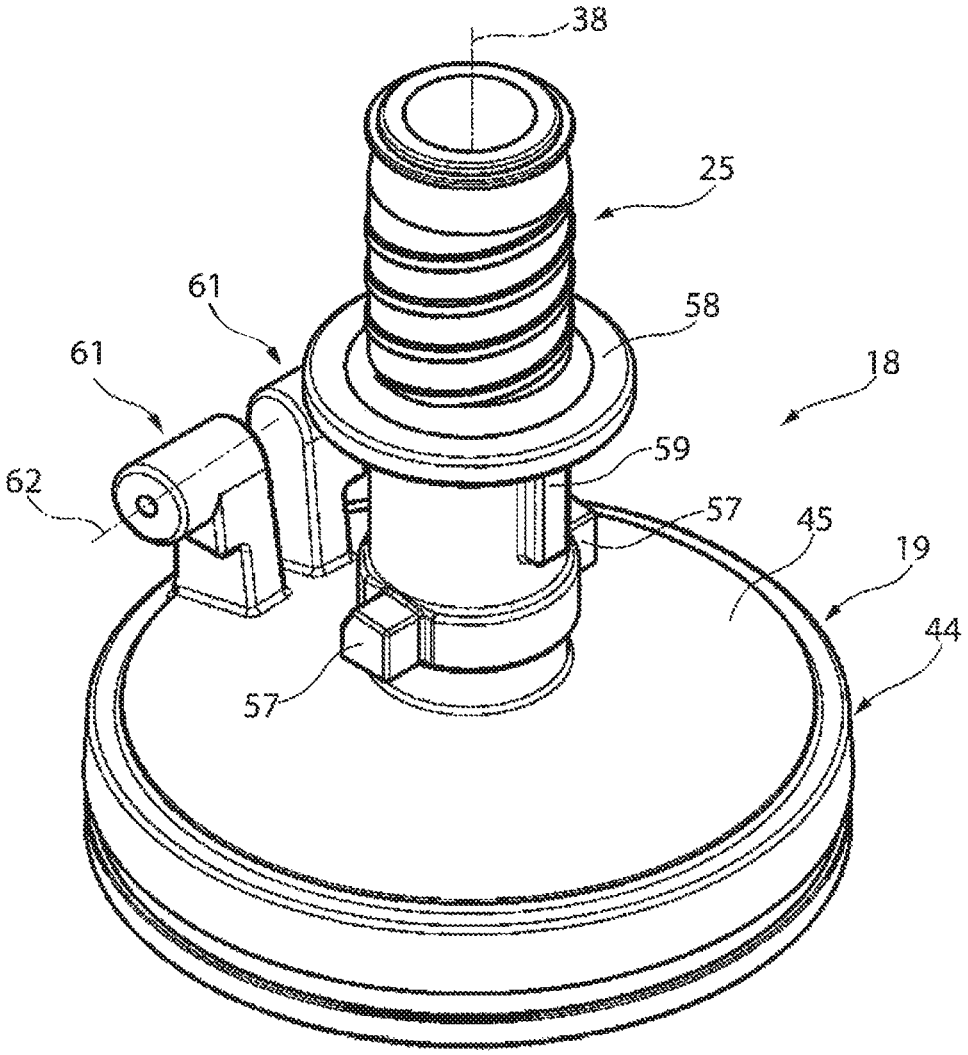
Figure 6:
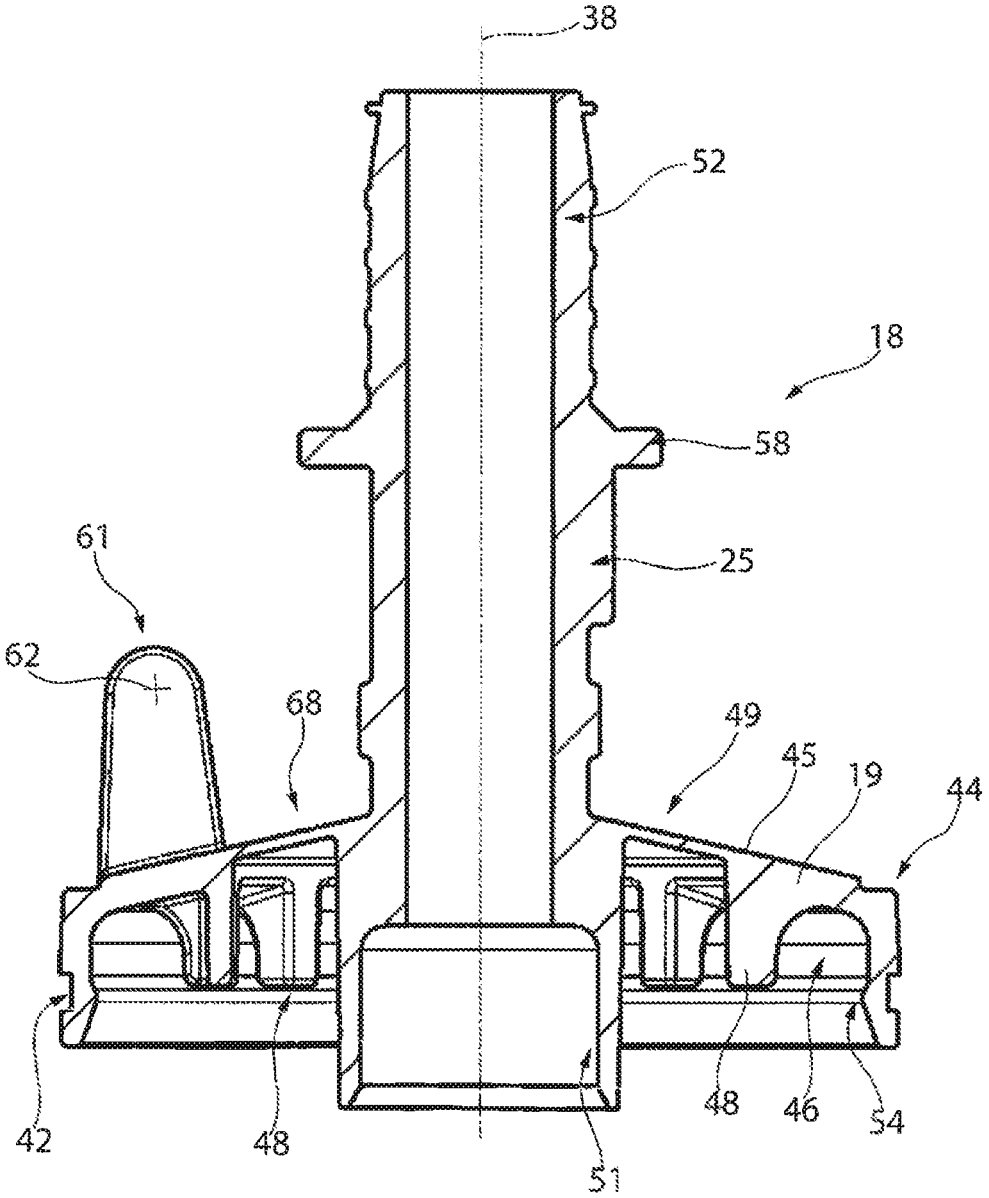
Figure 7:
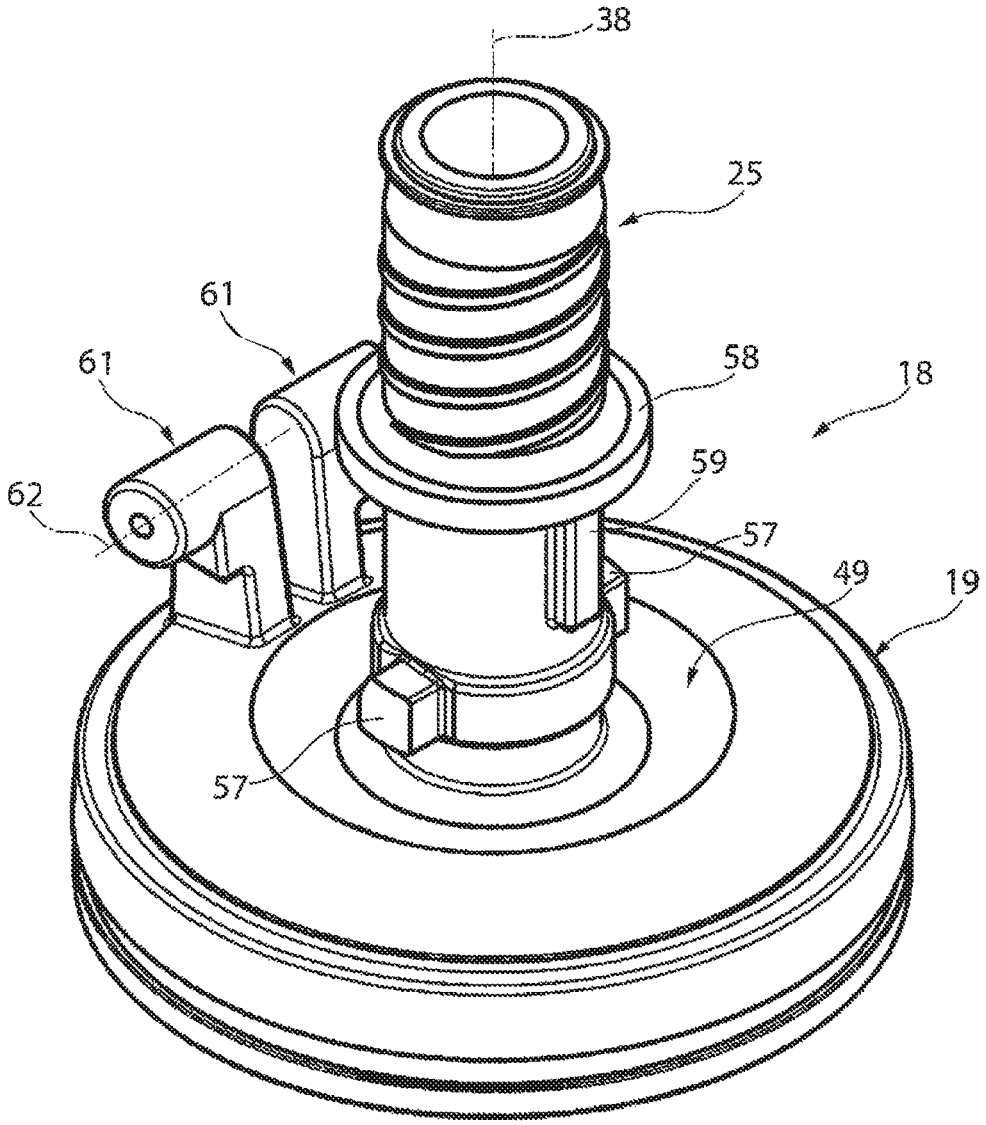
Figure 8:
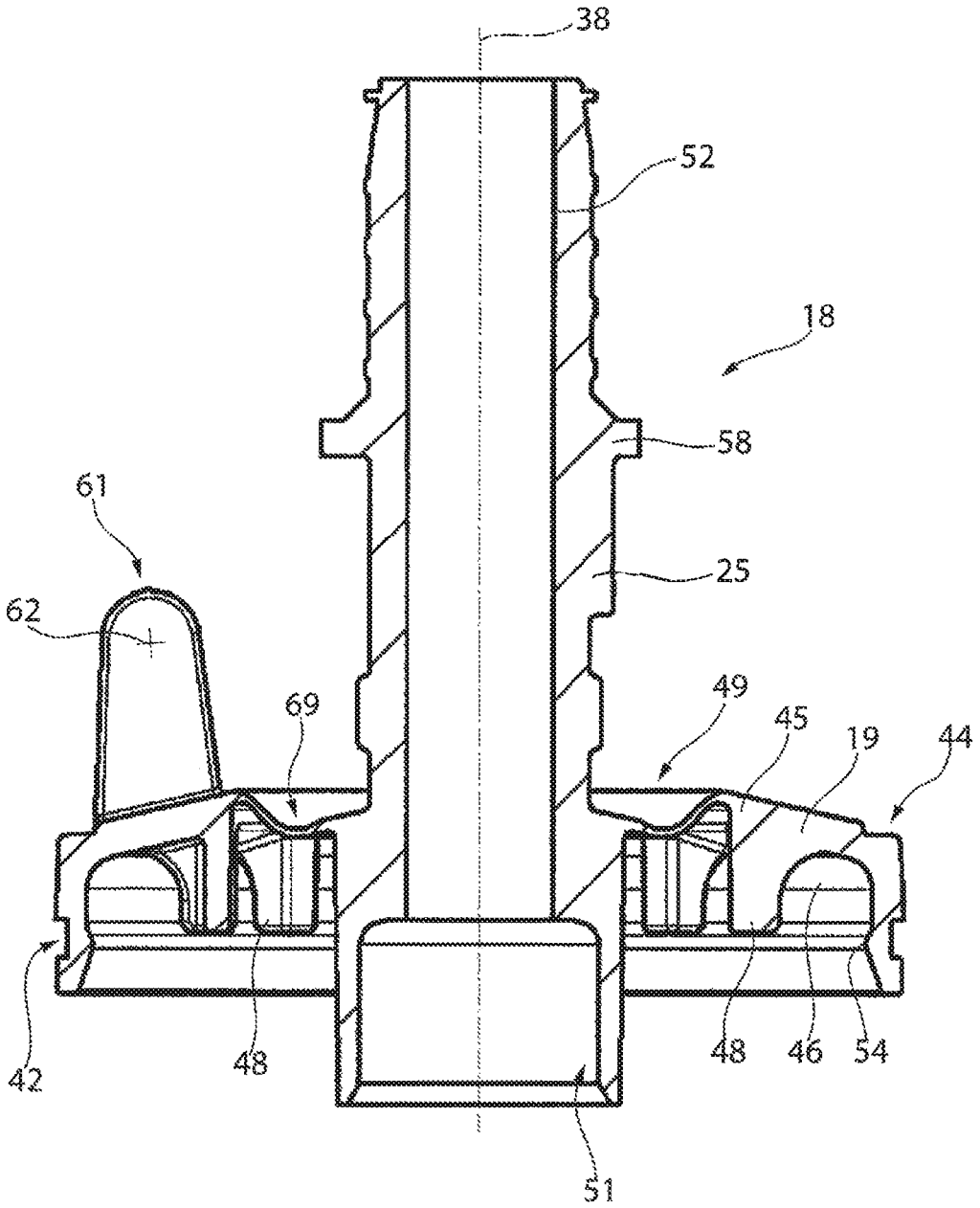
Figure 9:
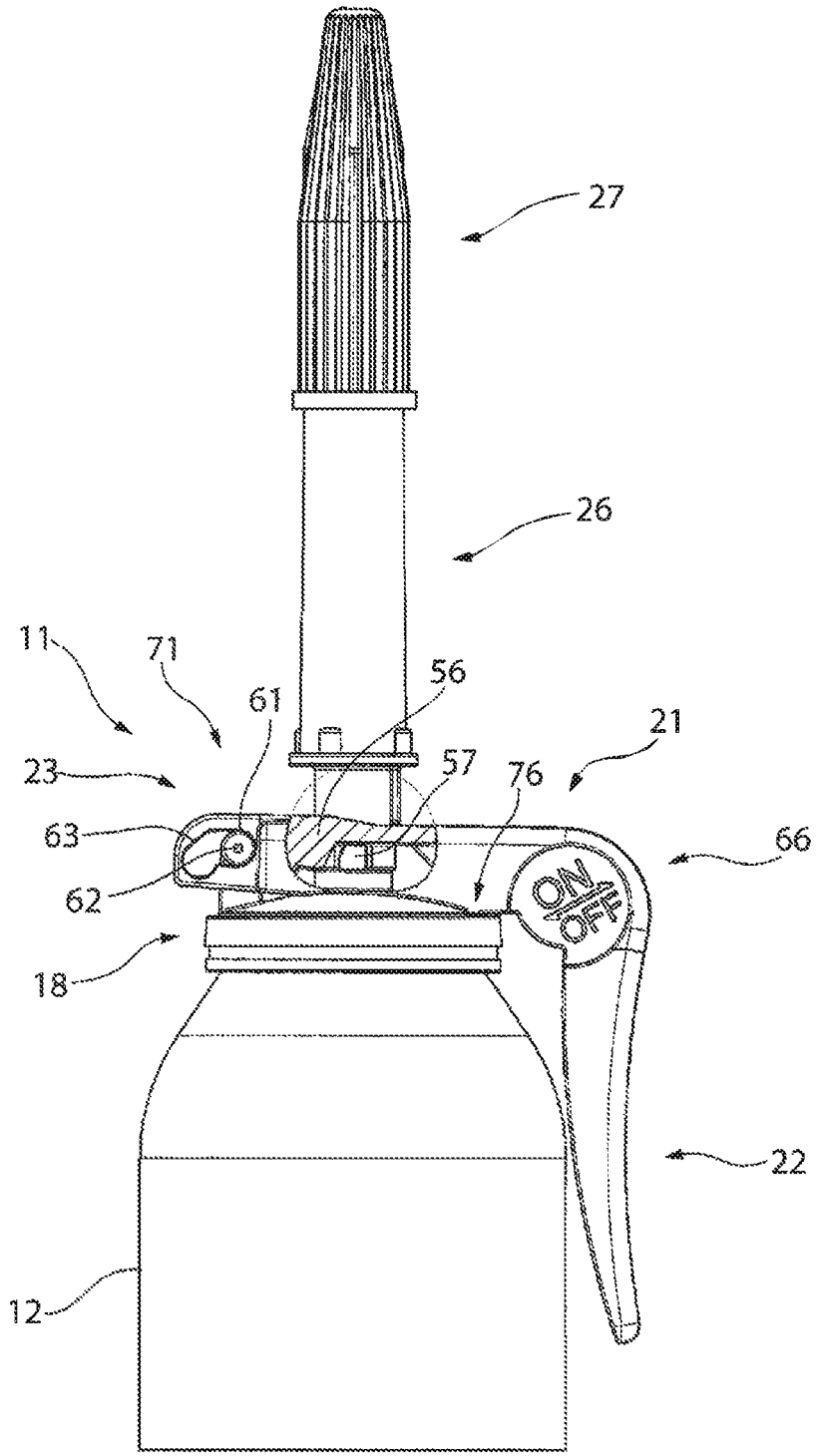
Figure 10:
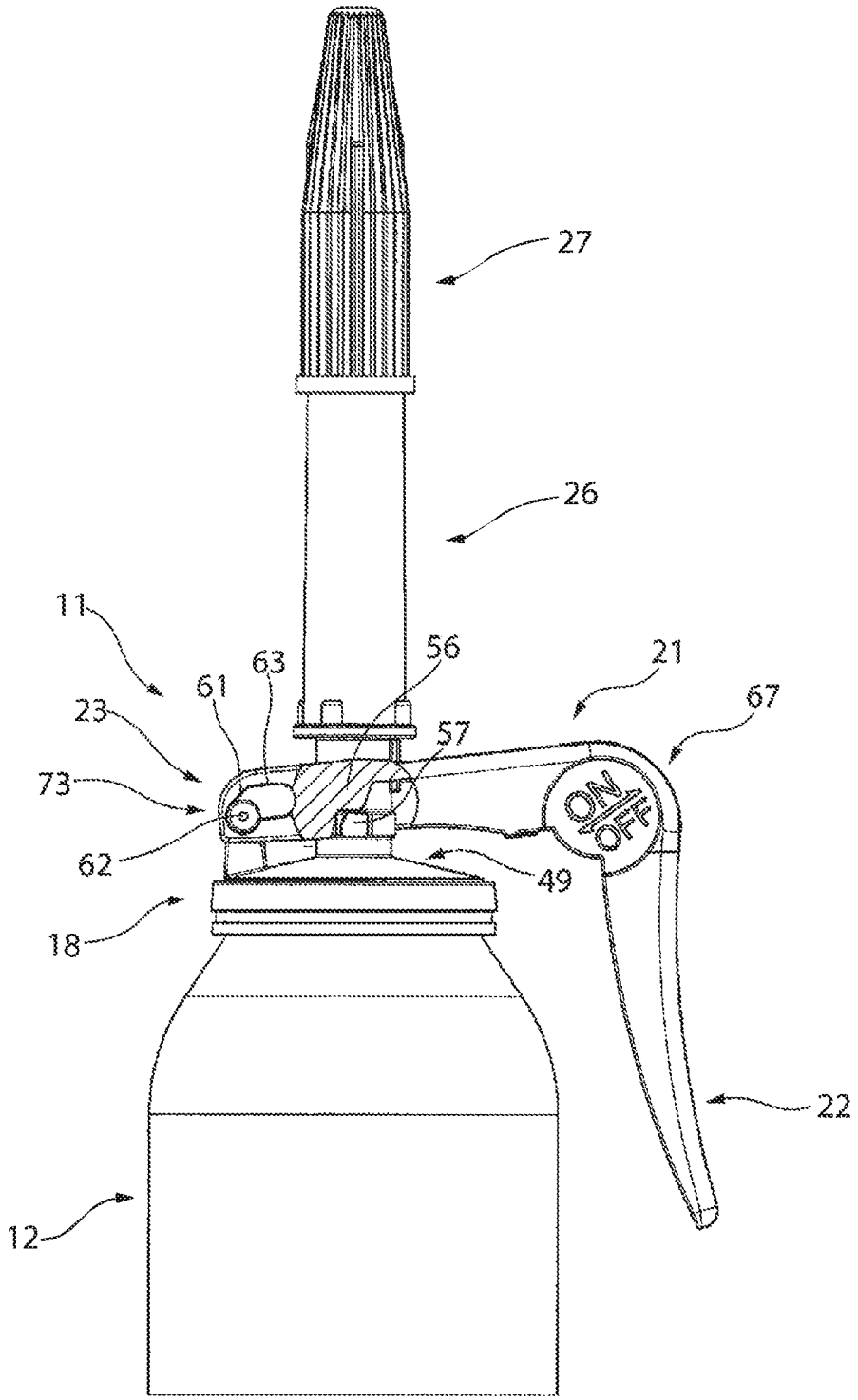
Figure 11:
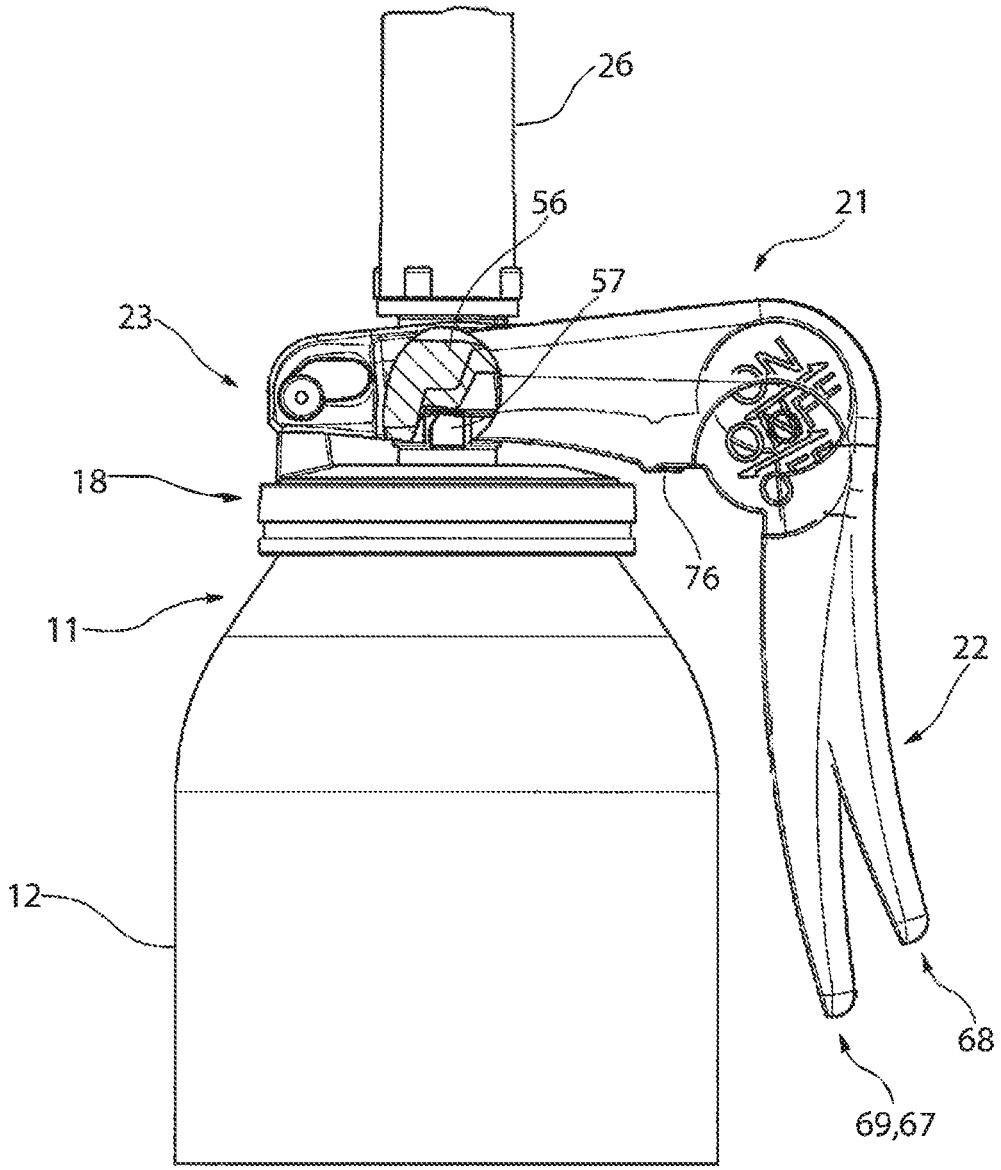
Figure 12:
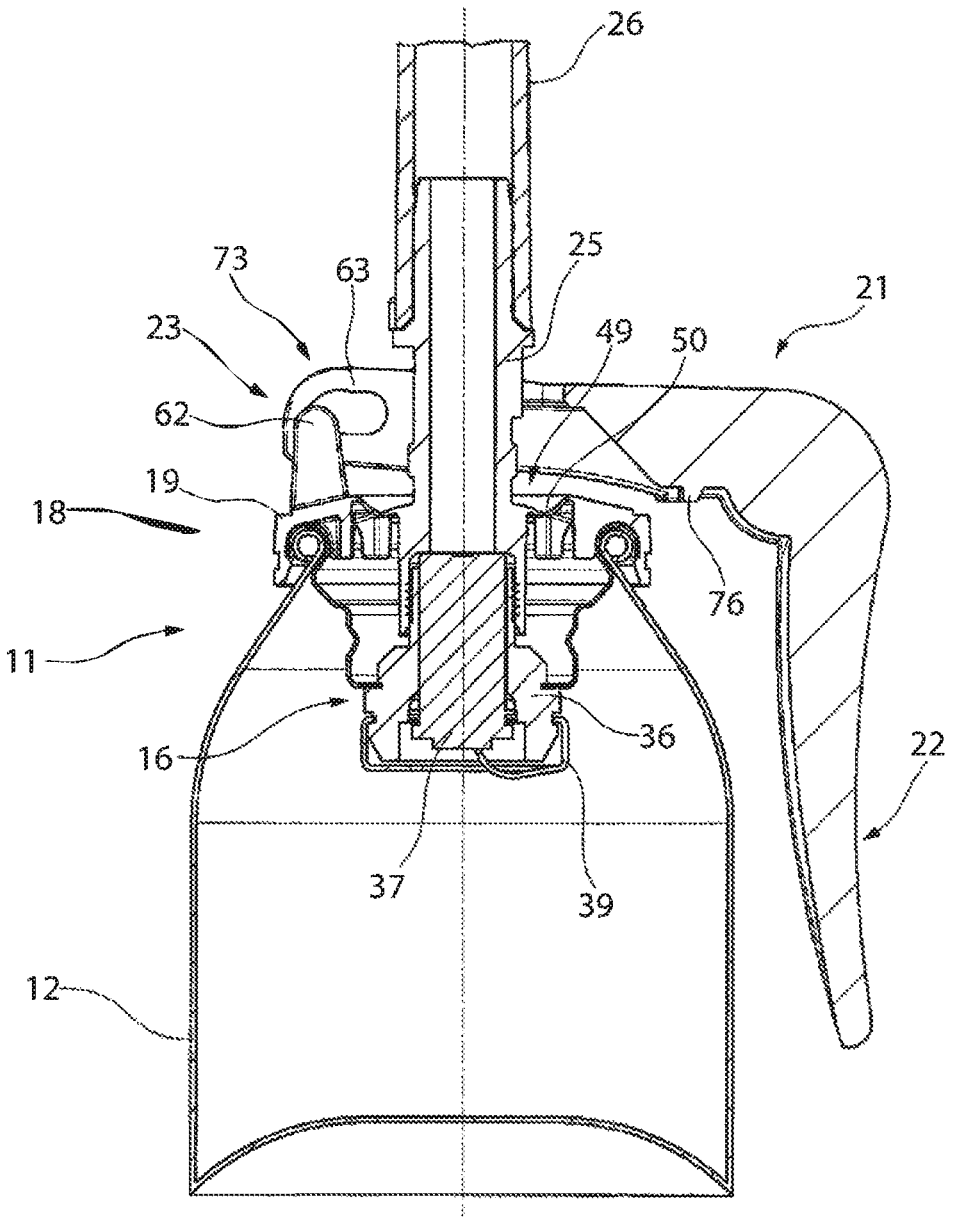

The invention and other advantageous embodiments and developments of the same are described and explained in greater detail below by means of the examples depicted in the drawings. The features to be gathered from the description and the drawings can be applied according to the invention individually or in groups in any combination. The figures show:

FIG. 1 an exploded drawing in perspective of the product dispenser with an adapter, FIG. 2 a depiction in perspective of the product dispenser in an assembled state in the delivery condition, FIG. 3 a schematic sectional view of the product dispenser with adapter according to FIG. 2, FIG. 4 another schematic sectional view of the product dispenser according to FIG. 2, FIG. 5 a view in perspective of the adapter, FIG. 6 a schematic sectional view of the adapter according to FIG. 5, FIG. 7 a view in perspective of the adapter in an active position, FIG. 8 a schematic sectional view of the adapter according to FIG. 7, FIG. 9 a schematic side view of the handle in a locked position, FIG. 10 a schematic side view of the handle in an unlocked position, FIG. 11 a schematic side view of an adapter on a product dispenser in a starting position and in an active position, and FIG. 12 a schematic sectional view of an adapter of the product dispenser with adapter in the active position.

In FIG. 1, a product dispenser 11 is depicted in an exploded drawing. On a container opening 14, which is closed by a valve 16 (FIG. 3), a pressure container 12 receives an adapter 18. This adapter 18 comprises an adapter base body 19, which can be placed on the container opening 14, and an actuating lever 21 with a handle 22, which is connected by a swivel arrangement 23 to the adapter base body 19.

The adapter base body 19 also has an output sleeve 25, to which a nozzle 26 can be attached, in particular screwed. The nozzle 26 can be exchanged thereby. A closure 27 is provided on a front end of the nozzle 26 to prevent the medium in the nozzle 26 from drying out.

Furthermore, a cap 29 is provided, which substantially encloses the adapter 18. This cap 29 has a recess 31, through which the actuating lever 21 is led out, so that the handle 22 is positioned outside the cap 29.

In FIG. 2 the components depicted in FIG. 1 are depicted in an assembled position. FIG. 2 shows a product dispenser 11 ready for sale.

An area of the recess 31 in the cap 29 is closed by a tamper-evident closure 32. This tamper-evident closure 32 is positioned in the recess 31 by several strut-like connections 33. The tamper-evident closure 32 can be released on at least two strut-like connections 33 to the recess 31, so that the quality closure remains loose and/or swivellable in the recess 31. The strut-like connections 33 form a predetermined breaking point in this case. The opening 30 can make the release of the tamper-evident closure 32 easier in that a tool can be introduced. If the tamper-evident closure 32 is missing, the user can clearly recognize that the product dispenser 11 had already been opened or used.

FIG. 3 shows a schematic sectional depiction of the product dispenser 11 in FIG. 2. FIG. 4 shows another sectional view of FIG. 3 rotated by 90°. Attached to a container opening 14 of the pressure container 12 is a valve 16, which closes the container opening 14. The valve 16 has a valve body 36, which comprises an outer circumferential edge, so that this outer circumferential edge engages on the container opening 14. This can be achieved, for example, by a screw connection or beading. The valve 16 comprises a valve closure member 37, which is movable along a longitudinal axis 38 of the valve 16 corresponding to the longitudinal axis 38 of the adapter base body 19. To open the valve closure member 37, this is moved in the direction of the pressure container 12 against a reset element 39, in particular a spring, to open a valve opening 41. A medium stored in the pressure container 12 passes through this valve opening 41 for outputting.

This valve 16 can correspond to the embodiment that is described, for example, in DE 10 2008 051 888 A1, to which reference is made in full.

The adapter 18 can be placed onto the container opening 14. This adapter 18 is shown in perspective in FIG. 5 and in a sectional view in FIG. 6. The adapter 18 according to FIGS. 5 and 6 is depicted in a starting position 68. On the adapter base body 19 a flange 44 is provided, which is aligned preferably coaxially with the longitudinal axis 38.

An end face 45 extends between the flange 44 and the output sleeve 25. Connected to the end face 45 and the flange 44 there is provided an attachment section 46, which extends along the flange 44, at least in sections. The attachment section 46 comprises webs 48, which are provided at a distance from the flange 44 and form a take-up area lying in between. On the lower edge of the flange 44, pointing in the direction of the longitudinal axis 38, a latching lug 54 is provided. An attachment section 46 can be formed thereby, which can engage around the beading or an edge 47 of the container opening 14 or of the pressure container 12 in a latching manner. A latching, clamping or snap connection can preferably be provided.

Also provided on the flange 44 of the adapter base body 19 on an outer circumference is a latching element 42, which forms a releasable latching connection with a latching element 43 on an inner side of the cap 29. The cap 29 can thereby be clipped onto the adapter.

The adapter base body 19 further comprises the output sleeve 25, which is connected by an elastic connection 49 to the adapter base body 19. The end face 45 extends between the adapter base body 19 and the output sleeve 25. Viewed in a sectional representation, this end face 45 is oriented in a roof-shaped manner. The end face 45 covers the attachment section or abuts this.

The elastic connection 49 extends between the output sleeve 25 and the end face 45. In a starting position 68 the elastic connection 49 and the end face 45 lie in a common plane. The elastic connection 49 is formed by an elastic membrane, which according to the embodiment depicted extends fully between the end face 45 of the flange 44 and the output sleeve 25. Due to this elastic connection 49, the position of the output sleeve 25 is variable along the longitudinal axis 38 with respect to the adapter base body 19. In particular, the output sleeve 25 is movable from the starting position 68 shown in FIG. 5 relative to the adapter base body 19 in the direction of the valve 16 of the pressure container 12. Such an active position 69 is depicted in FIGS. 7 and 8.

Furthermore, FIG. 6 shows that a connection 51 is provided at one end of the output sleeve 25. This connection 51 preferably engages around the valve closure member 37. Provided on the output sleeve 25 opposite the connection 51 is a receptacle 52, onto which the nozzle 26 can be placed or screwed. The output sleeve 25 has a through hole 53, which extends from the connection 51 to the receptacle 52. Laterally protruding cams 57 are provided on the output sleeve 25 between the receptacle 52 and the connection 51. Two radially protruding cams 57 lying opposite one another are preferably formed.

To actuate the output sleeve 25, at least one actuating element 56 on the actuating lever 21 can engage on these cams 57 of the output sleeve 25. This actuating lever 56 is depicted, for example, in FIG. 1 and described below in FIG. 5.

The receptacle 52 on the output sleeve 25 is delimited by an annular collar 58, so that after the nozzle 26 is put on it assumes a defined position. A projection 59 is provided from this annular collar 58 in the direction of the elastic connection 49, which projection protrudes in the form of a web with respect to the outer circumference of the output sleeve 25 and is arranged at a distance from the elastic connection 49. This projection 59 forms a portion of a transportation lock of the actuating lever 21 and handle 22, as will be discussed below in FIG. 9.

The adapter 18 is preferably formed in one piece with regard to its components depicted in FIGS. 5 and 6. The adapter base body 19 further takes up at least one, preferably two, swivel pins 61, which are used to form the swivel arrangement 23 together with the actuating lever 21. The swivel pins 61 form a common swivel axis 62. The swivel pins 61 are oriented in a mirror-inverted manner relative to one another and permit simple application and mounting of the actuating lever 21, so that the recesses arranged at one free end in the form of a slot 63 can be placed onto the swivel pins 61. In particular, the adapter 18 is manufactured from plastic as an injection-molded part. Alternatively, individual components can be assembled by a latching, snap or clamping connection to form the adapter 18.

FIG. 7 depicts a view in perspective of the adapter 18 in an active position 69. FIG. 8 shows a sectional view of the adapter 18 according to FIG. 7.

Reference is made to the description of FIGS. 5 and 6 in respect of the construction and the individual features and/or components of the adapter 18. The transfer of the adapter 18 to the active position 69 is made possible by the elastic connection 49. The output sleeve 25 and thus the connection 51 can be moved downwards, thus in the direction of the pressure container 12, by an actuating force along the longitudinal axis 38. The elastic connection 49 can deform thereby. An adjusting movement can be achieved by a deflection of an elastic connection 49. The elastic connection 49 is advantageously loaded uniformly, so that an annular depression is formed by the elastic connection 49. On relief of the actuating lever 21, the elastic connection 49 returns to its starting position 68, as is depicted by the adapter 18 according to FIGS. 5 and 6. In this starting position 68 the valve 16 of the pressure container 12 is closed again.

Alternatively to a circumferential elastic connection 49, several webs extending radially outwards with gaps formed in between can also be provided.

FIG. 9 depicts the actuating lever 21 with the handle 22 in the locked position 66. The swivel arrangement 23 is provided in a first end position 71. The actuating lever 21 is transferred by a displacement movement along a displacement path at right angles to the longitudinal axis 38 of the pressure container 12 into this first end position 71. The handle 22 is positioned close to the outer wall of the pressure container 12 or rests on this. In this locked position 66 the projection 59 lying externally on the output sleeve 25 engages on an outer side of the actuating lever 21, due to which a swivel movement of the actuating lever 21 in the direction of the nozzle 26 is blocked. In the opposite direction the swivel movement of the actuating lever 21 is blocked by a stop 76, which rests on the adapter base body 19. To secure the actuating lever 21 and the handle 22, the slot or slots 63 can have a constriction, so that on transfer of the swivel axis 62 to the first end position 71, a latching resistance, by which the actuating lever 21 can subsequently be held in this first end position 71, must be overcome. In this locked position 66 the actuating element 56 of the actuating lever is positioned adjacent to the cams 57 and is thus out of engagement.

The lugs formed on the actuating lever 21 each have slots 63 with an angled contour. This contour of the slots 63 comprises a first displacement path transverse or at right angles to the longitudinal axis 38 of the adapter base body 19. The first displacement path ends in the first end position 71. The second displacement path, which connects to the first displacement path, ends in the second end position 73. The second displacement path is inclined with respect to the first displacement path, in particular in the direction of the adapter base body 19. The actuating lever 21 with the handle 22 is held in one arrangement in the first end position 71 close to the pressure container 12. In an unlocked position 67 of the actuating lever 21 and handle 22, these can be moved further away with respect to the adapter base body 19 both in the direction of the longitudinal axis 38 and laterally to the longitudinal axis 38, in order to permit a reliable actuation of the handle 22 for outputting the medium.

The unlocked position 67 of the actuating lever 21 is shown in FIG. 8. The swivel axis 62 is located inside the slot 63 in a second end position 73. In this end position the actuating element 56 rests on the cams 57. The actuating lever 21 and the handle 22 are arranged in a starting position 68. In this starting position the product dispenser 11 is ready to output the medium on operation of the handle 22.

In FIG. 10 it is evident that the actuating element 56 rests on the cam 57. If the handle 22 or the actuating lever 21 is now transferred from the starting position 68 to an active position 69, as is depicted, for example, by the two positions of the handle 22 shown in FIG. 11, the cams 57 are moved towards the pressure container 12. The output sleeve 25 is led in the direction of the container opening 14 on account of the elastic connection 49 to the adapter base body 19. The valve closure member 37 is moved in the direction of the inside of the pressure container 12. The valve opening 31 is opened and the medium can emerge.

As soon as the handle 22 is no longer operated, the actuating lever 21 with the handle 22 returns autonomously from the active position 69 to the starting position 68. This autonomous transfer to a closed position is produced by the reset element 39 of the valve 16.

In the active position 69 and starting position 68 the actuating lever 21 is arranged in the second end position 73 of the swivel arrangement 23. In this second end position 73, the actuating element 56 is positioned relative to the projection 59 so that in the swivel movement of the handle 22, the output sleeve 25 can be moved along the longitudinal axis 38 towards the pressure container 12.

FIG. 12 depicts a schematic sectional view of the product dispenser with an unlocked adapter 18. The handle 22 is transferred to an active position 69 for outputting of the medium. This sectional view shows that the output sleeve 25 has travelled with respect to the annular adapter base body 19 along the longitudinal axis 38. This is to be recognized by a deflection 50 of the elastic connection 49, which extends between the output sleeve 25 and the annular adapter base body 19.

The adapter 18 can be provided as a sales unit. The actuating lever 21 is mounted on the swivel axis 62 and forms a fixed swivel arrangement. The cap 29 can be attached additionally to the adapter base body 19. To fit the cap 29, the handle 22 and the actuating lever 21 are led through the recess 31 of the cap 29 and then the cap 29 is connected to the adapter base body 19, in particular latched. This assembly unit can subsequently be connected to the container opening 14 of the pressure container 12 by a clip or latching connection with the circumferential edge. The nozzle 26 can be optionally screwed on to complete the product dispenser 11.

The invention claimed is:

1. An adapter for a product dispenser with an adapter base body for positioning the adapter on a container opening of a pressure container, with a swivel arrangement, which adjusts an actuating lever with a handle swivellably to the adapter base body for moving the actuating lever between an unlocked position, in which the handle for opening a valve of the container is operable from a starting position into an active position to enable outputting a medium from the pressure container, and a locked position, in which operation of the handle is blocked to prevent outputting the medium from the pressure container, wherein the swivel arrangement is formed by a swivel axis and at least one slot and the swivel axis can be arranged in a first end position and in a second end position in the at least one slot.

2. The adapter according to claim 1, wherein a displacement movement of the actuating lever is guided by the swivel arrangement and the actuating lever is displaceable relative to an output sleeve on the adapter base body.

3. The adapter according to claim 1, wherein the swivel arrangement has the at least one slot with an angled progression, by which the first and second end position for the swivel axis is separated and by which the handle is adjustable from the locked position to an unlocked position with a greater distance from the adapter base body.

4. The adapter according to claim 1, wherein the displacement movement of the actuating lever for locking and unlocking has a first displacement path, which is provided transverse to the longitudinal axis of the adapter base body, and a second displacement path connected thereto, which is inclined relative to the first displacement path.

5. The adapter according to claim 1, wherein the actuating lever has a stop, which is provided pointing towards the adapter base body and lying opposite has a projection arranged on an output sleeve of the adapter base body, which projection points towards the actuating lever and is provided as a transport safeguard.

6. The adapter according to claim 5, wherein the actuating lever is held clamped in the locked position between the adapter base body and the projection on the output sleeve.

7. The adapter according to claim 1, wherein at an end of the actuating lever lying opposite the handle there is provided the at least one slot, which forms the swivel arrangement with the swivel axis fixedly arranged on the adapter base body.

8. The adapter according to claim 1, wherein the adapter base body comprises the output sleeve, which is connected to the adapter base body via an elastic connection, so that the output sleeve is displaceable along the longitudinal axis of the adapter base body.

9. The adapter according to claim 8, wherein the elastic connection is a membrane or a joint.

10. The adapter according to claim 1, wherein in the unlocked position, an actuating element of the actuating lever engages on a cam or an annular collar on the output sleeve.

11. The adapter according to claim 5, wherein the output sleeve has a connection for actuating a valve closure member and lying opposite has a receptacle, to which a nozzle is attachable.

12. The adapter according to claim 1, wherein a cap is placeable on the adapter base body, which cap encloses the swivel arrangement and the adapter base body.

13. The adapter according to claim 12, wherein the cap has a recess, through which the actuating lever is led out and the handle is arranged outside the cap and that a tamper-evident closure is provided in the recess.

14. The adapter according to claim 13, wherein the tamper-evident closure is provided by at least one web-shaped linkage of the recess, which serves as a predetermined breaking point.

15. A product dispenser with a pressure container for receiving a medium to be output, with a valve, which closes a container opening, comprising an adapter with an adapter base body for positioning the adapter on a container opening of a pressure container, with a swivel arrangement, which adjusts an actuating lever with a handle swivellably to the adapter base body for moving the actuating lever between an unlocked position, in which the handle for opening a valve of the container is operable from a starting position into an active position to enable outputting a medium from the pressure container, and a locked position, in which operation of the handle is blocked to prevent outputting the medium from the pressure container, wherein the swivel arrangement is formed by a swivel axis and at least one slot and the swivel axis can be arranged in a first end position and in a second end position in the at least one slot and the adapter is attachable to the container opening of the pressure container.

16. The product dispenser according to claim 15, wherein the adapter is clippable or screwable onto an edge of the container opening of the pressure container.

* * * * *